United States Patent [19]

Lin

[11] Patent Number: 4,961,571

[45] Date of Patent: Oct. 9, 1990

[54] EXERCISING APPARATUS

[76] Inventor: Tsai-Lain Lin, No. 27, Alley 2, Lane 437, Pei Twen Rd., Taichung, Taiwan

[21] Appl. No.: 471,404

[22] Filed: Jan. 29, 1990

[51] Int. Cl.[5] ..... A63B 22/00

[52] U.S. Cl. ..... 272/73

[58] Field of Search ..... 272/73, 72, 71, 115, 272/128, 17, 18, 131–132; 128/25 R

[56] References Cited

U.S. PATENT DOCUMENTS

| | | | |
|---|---|---|---|
| 351,311 | 10/1886 | Conkling | 272/73 |
| 3,758,107 | 9/1973 | Potgieter | 272/23 |
| 4,611,807 | 9/1986 | Castillo | 272/73 |
| 4,770,411 | 9/1988 | Armstrong et al. | 272/73 |
| 4,802,666 | 2/1989 | Rodriqguez | 272/73 |

*Primary Examiner*—Stephen R. Crow

*Attorney, Agent, or Firm*—Staas & Halsey

[57] ABSTRACT

An exercising apparatus includes a frame body having a lower beam and an upper beam fixed together by a post. A seat is provided on a rear end of the upper beam. Three roller sets are fixed in the frame body. A wheel is rotatably supported by the roller sets and is inscribed in the roller sets. The roller sets are evenly distributed around a peripheral surface of the wheel. Two pedals are fixed on both sides of the wheel and are 180 degrees apart. The wheel is rotatably engaged with the roller sets in frictional relationship.

4 Claims, 3 Drawing Sheets

EXERCISING APPARATUS

BACKGROUND OF THE INVENTION

The invention relates to an exercising apparatus.

Various types of exercising apparatus are used nowadays. One type of the exercising apparatus is disclosed in U.S. Pat. No. 4,188,030 to Hooper. A similar exercising apparatus is disclosed in U.S. Pat. No. 4,657,244 to Ross. Still another type of exercising apparatus is disclosed in U.S. Pat. No. 4,660,826 to Lee. All the exercising apparatus mentioned above use a sprocket to drive a wheel or the like.

The present invention has arisen to provide an exercisng apparatus in which the wheel or the like of the exercising apparatus is driven without sprocket.

SUMMARY OF THE INVENTION

The primary objective of the present invention is to provide an exercising apparatus which has a wheel or the like being driven without a sprocket.

In accordance with one aspect of the invention, there is provided an exercising apparatus which includes a frame body having a lower beam and an upper beam fixed together by a post. A seat is provided on a rear end of the upper beam. Three roller sets are fixed in the frame body. A wheel is rotatably supported by the roller sets and is inscribed in the roller sets. The roller sets are evenly distributed around a peripheral surface of the wheel. Two pedals are fixed on both sides of the wheel and are 180 degrees apart. The wheel is rotatably engaged with the roller sets in frictional relationship.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
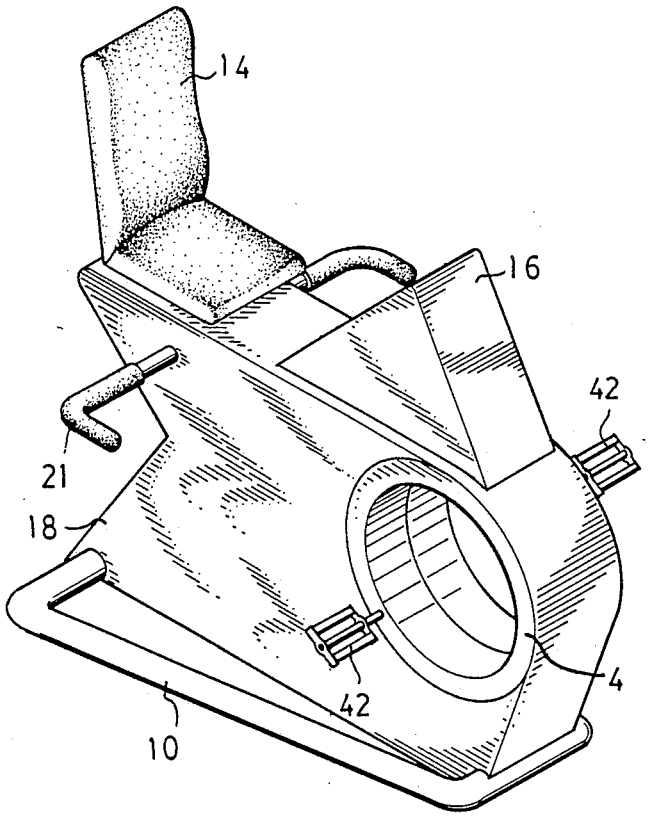
FIG. 1 is a perspective view of an exercising apparatus in accordance with the present invention.
Figure 2:
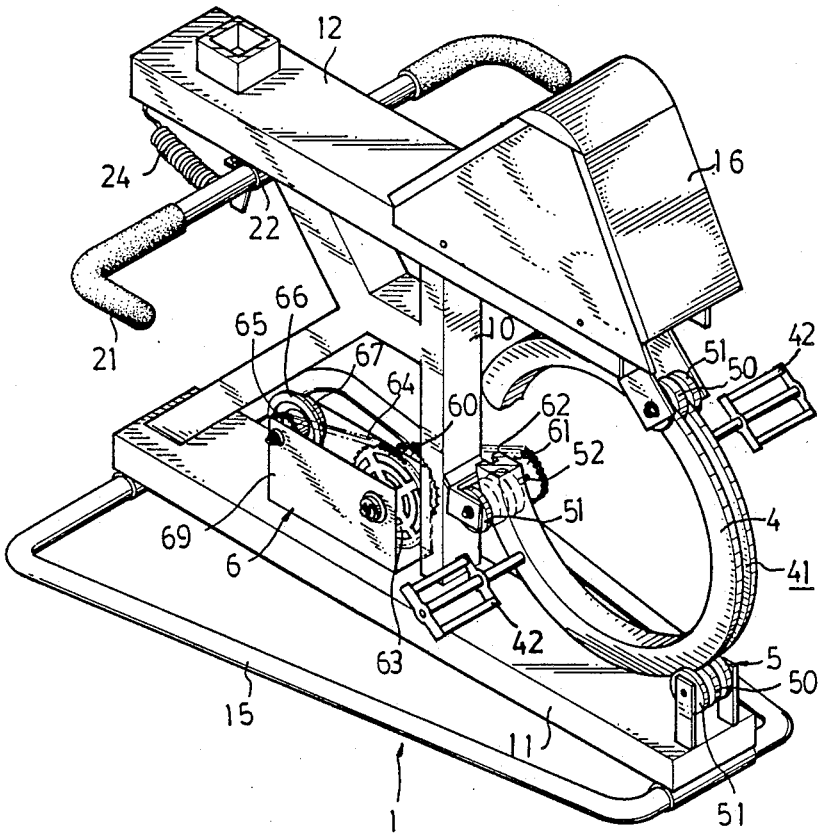
FIG. 2 is a perspective view of the exercising apparatus of FIG. 1, in which a casing thereof is removed.

Referring to the drawings, the exercising apparatus in accordance with the present invention comprises generally a frame body 1, a wheel 4 rotatably provided in the frame body 1, and an energy absorbing mechanism 6.

Figure 3:
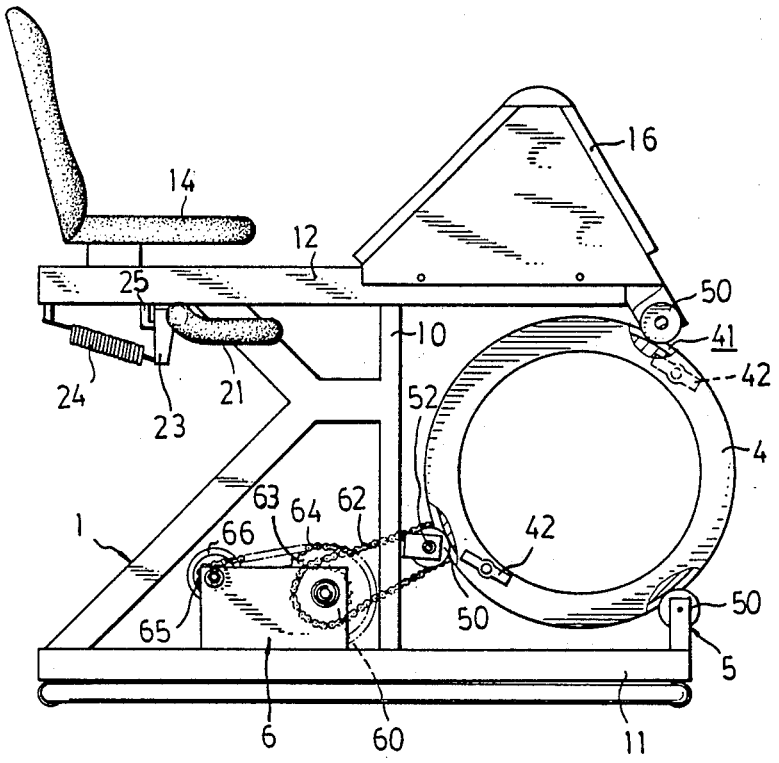
FIG. 3 is a plane view of the exercising apparatus of FIG. 2.

The frame body 1 is substantially I-shaped including a post 10, a lower beam 11 and an upper beam 12. An enlarged base frame 15 is provided on the lower end of the frame body 1. A seat 14 is provided on a rear end of the upper beam 12. A casing 18 is provided to enclose the frame body 1. A center portion of a handle bar 21 is rotatably received in a sleeve 22 which is fixed on a lower surface of the upper beam 12. A lug 23 is fixed to the handle bar 21 so that the lug 23 and the handle, bar 21 rotate in concert. A spring 24 is coupled between a rear end of the upper beam 12 and a lower end of the lug 23 so that the handle bar 21 is biased to rotate clockwise as shown in FIG. 3. A stop 25 is fixed on the lower surface of the upper beam 12 and close to the lug 23 in order to limit a rearward movement of the lug 23 and the handle bar 21. The handle bar 21 provides exercise for muscle groups in the upper part of the body. A housing 16 is provided on a front end of the upper beam 12 for supporting speedometer, timer or clock (not shown) etc.

The wheel 4 is substantially a ring with an annular recess 41 formed in an outer peripheral surface thereof. Two pedals 42 are provided on the different sides of the wheel 4 and are 180 degrees apart. Three roller sets 5 are provided in the frame body 1 and are distributed around the wheel 4, i.e., the wheel 4 is inscribed in the roller sets 5. It is preferable that the three roller sets 5 are spaced by 120 degrees. One of the roller sets 5 is fixed on a front end of the upper beam 12, one is fixed on a front end of the lower beam 11 and the other one is fixed on a middle portion of the post 10. Each roller set 5 includes a middle roller 50 and two outer rollers 51, in which the middle roller 50 is relatively slidable along and is engaged with the annular recess 41 of the wheel 4 in frictional relationship. The wheel 4 is rotatably supported by the three roller sets 5. A rotation of the wheel 4 makes a relative rotation of the pivot axles 52 of the three roller sets 5. The two outer rollers 51 of each roller set 5 contact the outer surfaces of the wheel 4 in sliding relationship.

The energy absorbing mechanism 6 is substantially of a type of two chain gearing sets including a driving pinion 61 (FIG. 20) and a driven gear 60 coupled by a chain 62, and a driving gear 63 and a driven pinion 65 coupled by a chain 64. The driving pinion 61 is fixed to the axle 52 of the roller set 5 which is fixed on the post 10 so that the driving pinion 61 and the rollers 50, 51 are rotated in concert. The driven gear 60 and the driving gear 63 are coaxial and move in concert and are rotatably supported on a front portion of a pair of plates 69 which are fixed on a rear end of the lower beam 11. A brake disc 66 and the driven pinion 65 are coaxial, move in concert and are rotatably supported on a rear portion of the plates 69. A brake shoe 67 is fixed on one of the plate 69 and frictionally contacts the brake disc 66. The frictional engagement between the brake disc 66 and the brake shoe 67 controls the energy absorbing rate of the energy absorbing mechanism 6. The wheel 4 provides an exercise of the muscles of the legs and lower torso of the user.

Accordingly, the exercising apparatus in accordance with the present invention provides a new configuration of the exercising apparatus. The wheel 4 of the excercising apparatus is driven directly by the pedals without a sprocket.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising apparatus comprising a frame body including a lower beam and an upper beam fixed together by a post; a seat being provided on a rear end of said upper beam; at least three roller sets fixed on said frame body; and axleless wheel rotatably and solely supported by said roller sets and inscribed in said roller sets; said roller sets evenly, circumferentiatlly distributed around a peripheral surface of said wheel; two pedals fixed on respective perimeter sides of said wheel and 180 degrees apart; said wheel rotatably engaged with said roller sets in frictional relationship; and an energy absorbing mechanism coupled to one of said roller sets.

2. An exercising apparatus according to claim 1, wherein three roller sets are used, a first one is fixed on a front end of said upper beam, a second one is fixed on a front end of said lower beam, and a third one is fixed on said post; each roller set includes at least one roller; an annular groove is formed in an outer peripheral surface of said wheel; and said rollers of said roller set are rotatably engaged in said annualar groove of said wheel in frictional relationship.

3. An exercising apparatus according to claim 2, wherein said energy absorbing mechanism is provided on a rear portion of said lower beam and includes a pair of plates fixed on said lower portion of said lower beam; a driving pinion and a driven gear coupled by a first chain; a driving gear and a driven pinion coupled by a second chain; said driving pinion fixed on an axle of said third roller set so that said driving pinion and said roller of said third roller set are rotated in concert; said driven gear and said driving gear coaxially supported on said plates and rotated in concert; said driven pinion and a brake disc coaxially supported on said plates and rotated in concert; and a brake shoe fixed on one of said plates and frictionally contacted with said brake disc.

4. An exercising apparatus according to claim 1, wherein a center portion of a handlebar is rotatably supported in a sleeve which is fixed on said rear end of said upper beam; a lug is fixed to said handlebar and is rotated in concert with said handlebar; a spring is coupled between said rear end of said upper beam and a lower end of said lug so that said handle bar is biased to rotate; and a stop is fixed beside said lug for limiting movement of said lug and said handlebar.

* * * * *